US010111519B2

(12) United States Patent
Rassam

(10) Patent No.: US 10,111,519 B2
(45) Date of Patent: Oct. 30, 2018

(54) EXPANDABLE FURNITURE

(71) Applicant: Saad Minur Bashir Rassam, Kent (GB)

(72) Inventor: Saad Minur Bashir Rassam, Kent (GB)

( * ) Notice: Subject to any disclaimer, the term of this patent is extended or adjusted under 35 U.S.C. 154(b) by 0 days.

(21) Appl. No.: 15/318,081

(22) PCT Filed: Jun. 1, 2015

(86) PCT No.: PCT/GB2015/051587

§ 371 (c)(1),
(2) Date: Dec. 12, 2016

(87) PCT Pub. No.: WO2015/193637

PCT Pub. Date: Dec. 23, 2015

(65) Prior Publication Data

US 2017/0119148 A1 May 4, 2017

(30) Foreign Application Priority Data

Jun. 19, 2014 (GB) ..... 1410939.1

(51) Int. Cl.

| | |
|---|---|
| ***A47B 45/00*** | (2006.01) |
| ***A47B 65/00*** | (2006.01) |
| ***A47B 1/02*** | (2006.01) |
| ***A47B 61/00*** | (2006.01) |
| ***A47B 67/04*** | (2006.01) |

(52) U.S. Cl.

CPC ..... *A47B 45/00* (2013.01); *A47B 1/02* (2013.01); *A47B 61/00* (2013.01); *A47B 65/10* (2014.12); *A47B 67/04* (2013.01)

(58) Field of Classification Search

CPC ..... A47B 57/00; A47B 13/023; A47B 45/00; A47B 65/10; A47B 1/02; A47B 61/00; A47B 67/04; B65D 21/086

USPC ..... 312/205, 198

See application file for complete search history.

(56) References Cited

U.S. PATENT DOCUMENTS 1,819,516 A * 8/1931 Kelly ..... B60R 7/04 108/149
2,369,728 A * 2/1945 Farkas ..... A47G 23/06 206/557
2,475,961 A * 7/1949 Hilbert ..... A45C 7/0031 190/105

(Continued)

OTHER PUBLICATIONS

Intellectual Property Office GB1410939.1—Patents Act 1977: Search Report under Section 17, dated Nov. 25, 2014 (1 page).

*Primary Examiner* — Janet M Wilkens
(74) *Attorney, Agent, or Firm* — Luedeka Neely Group, PC

(57) ABSTRACT

An expandable storage structure (10) comprises at least one extendable wall. The extendable wall comprises at least three slidably engaged panels (30, 32, 36), and at least a first and second panel (30, 32) are co-planar. At least one of the panels (30, 32, 36) is hollow and receives at least a part of at least one of the other panels (30, 32, 36). The first and second panels (30, 32) are movable relative to each other panel (30, 32, 36) in order to adjust a dimension of the wall. A linkage mechanism (34) connects the first and second panels (30, 32) and is configured to allow relative movement between the panels (30, 32, 36) while maintaining the first and second panels (30, 32) in the same plane as each other.

7 Claims, 6 Drawing Sheets

(56) References Cited

U.S. PATENT DOCUMENTS

| | | | | | |
|---|---|---|---|---|---|
| 2,543,263 | A * | 2/1951 | Vanderveld | A47B 87/008 | 160/229.1 |
| 2,968,520 | A * | 1/1961 | Abrens | A47B 45/00 | 312/246 |
| 3,691,671 | A * | 9/1972 | Kroll | A63H 3/52 | 220/8 |
| 4,033,649 | A * | 7/1977 | Naito | A47B 53/02 | 312/198 |
| 4,286,525 | A | 9/1981 | Willmore | | |
| 5,016,772 | A * | 5/1991 | Wilk | B65D 21/086 | 220/495.01 |
| 5,435,644 | A * | 7/1995 | Schuh | F16M 1/00 | 211/186 |
| 5,472,082 | A * | 12/1995 | Thiele | A45C 7/0031 | 190/105 |
| 6,271,467 | B1 * | 8/2001 | Book | H02L 313/005 | 174/496 |
| 6,467,622 | B1 * | 10/2002 | Hull | B65D 1/36 | 206/553 |
| 7,451,912 | B1 * | 11/2008 | Taube, II | A47G 29/1209 | 232/17 |
| 7,594,706 | B2 * | 9/2009 | Styka | A47B 88/40 | 312/205 |
| 8,376,477 | B2 * | 2/2013 | Schinzing | A47B 45/00 | 312/205 |
| 8,608,262 | B1 | 12/2013 | Daros | | |
| 2004/0070318 | A1 * | 4/2004 | Shai | A47B 61/06 | 312/205 |
| 2005/0073223 | A1 * | 4/2005 | Shai | A47B 61/06 | 312/205 |
| 2009/0250176 | A1 | 10/2009 | Ryan et al. | | |

* cited by examiner

EXPANDABLE FURNITURE

CROSS-REFERENCE TO RELATED APPLICATION

This application claims priority under all applicable statutes, and is a U.S. National phase (37 U.S.C. Section 371) of international Application PCT/GB2015/051587, filed Jun. 1, 2015, and entitled EXPANDABLE FURNITURE, which claims priority to GB 1410939.1, filed Jun. 19, 2014, incorporated herein by reference in their entireties.

The present invention relates to furniture, and storage structures generally, which can be expanded and contracted to allow the item to fit into a given space.

Items of furniture such as wardrobes, cupboards, storage chests, kitchen cabinets, shelving units etc. are usually made rigid and of fixed dimensions. Frequently such dimensions do not exactly fit the space in which it is desired to locate the item. Therefore, an item of smaller dimensions than really required has to be used, leaving an awkward and inefficient gap, for example when placing a wardrobe into an alcove beside a chimney breast.

Some extendable items of furniture are already known, such as extendable dining tables which have one or more flaps which can be pulled or folded out to extend the table. However, these provide a fixed amount of additional length. Extendable beds for young children are also known comprising a frame which can be fitted together at different locations to provide a different length of bed. Once again, only a certain number of fixed dimensions are possible.

The present invention provides a storage structure comprising at least one extendable wall, wherein the extendable wall comprises at least three slidably engaged panels, wherein: at least a first panel and a second panel are co-planar; at least one of the panels is hollow and receives at least part of at least one of the other panels; the first and second panels are movable relative to each other panel in order to adjust a dimension of the wall; and a linkage mechanism connects the first and the second panels to each other and is configured to allow relative movement between the panels while maintaining the first and second panels in the same plane as each other.

In this way, a simple structure is provided in which the panels can be placed in any desired position relative to each other in order to freely adjust a dimension of the structure as desired. The linkage assists with stability and controlled movement of the panels.

Advantageously, the storage structure comprises first, second and third panels and the linkage is secured to the third panel, whereby when the first or the second panel moves relative to the third panel, the linkage causes the second or first panel respectively to move by the same distance and in the opposite direction. This assists with easy adjustment of the panels and ensures the extendable wall remains symmetrical about the third panel.

In one example, the linkage comprises at least one linkage bar with a first end pivotally and slidably secured to the first panel, a second end pivotally and slidably secured to the second panel and a midpoint pivotally secured to the third panel.

In another example, the linkage comprises a plurality of linkage bars, each pivotally secured to an adjacent linkage bar to form a zigzag configuration, and wherein the linkage bar at each end of the zigzag configuration is pivotally secured to a respective panel.

In yet another example, the linkage comprises a first toothed rack mounted on a projection extending from the first panel, a second toothed rack mounted on a projection extending from the second panel, and a toothed wheel engaged with the first and second toothed racks.

Typically, the first and second panels are located at opposing sides of a centrally located third panel.

In one embodiment of the present invention, the third panel is hollow and receives at least part of both the first and second panels.

In a further embodiment of the present invention, the first and second panels are hollow and each receive at least part of the third panel.

In another embodiment of the present invention, the storage structure further comprises a fourth panel, which is hollow and slidably engaged to receive at least a part of the first, second and third panels.

Preferably the first panel is movable in a first direction relative to the third panel, and the second panel is movable in a second direction relative to the third panel, wherein the first and second directions are perpendicular, and the fourth panel is movable in both directions relative to the third panel.

Preferably, the third panel is substantially rectangular, and the first and second panels are substantially right triangular, wherein the first and second panels are mounted such that the right angles of each triangle are arranged to engage with opposing corners of the third panel, and wherein the fourth panel is also substantially right triangular and the right angle of the fourth panel is arranged to engage with a third corner of the third panel. In this manner the substantially rectangular shape of the wall may be maintained.

Preferably, guide rails are located in the hollow panel(s) to guide and support the other panel(s). Alternatively, or in combination, bearings may be located in the hollow panel(s) to guide and support the other panel(s).

Preferably, stop means are provided to limit movement of movement of the first and second panels relative to the third panel.

Preferably the linkage is configured to define a minimum and maximum separation of the first and second panels and to allow infinite adjustment within that range.

It is also preferable if the linkage remains located within the hollow panel(s) throughout the range of separation permitted by the linkage.

The storage structure of the present invention may comprise a body formed of a plurality of walls, wherein at least some of the walls comprise extendible walls of the type described above, to allow a dimension of the storage structure to be extended.

The storage structure may comprise one of a wardrobe, cupboard, cabinet, shelf, table, work surface, shelving unit, bookcase, chest of drawers, box, sideboard, or shed.

The invention will now be described in detail, by way of example only, with reference to the accompanying drawings in which.

The present invention relates to storage structures generally. The term storage structure is therefore intended to encompass the simplest structures which provide a surface on which items can be stored, for example, a shelf, table top or work surface, and also to encompass more complex structures providing a storage volume and one or more storage surfaces, such as wardrobes, cupboards, cabinets, shelving units with multiple shelves, boxes, chests, chests of drawers, etc. The term storage structure is also intended to cover items used not just in a domestic setting, but items used in other settings such as retail or industrial environments, and items used both within buildings and externally which such as storage chests or sheds.

Figure 1:
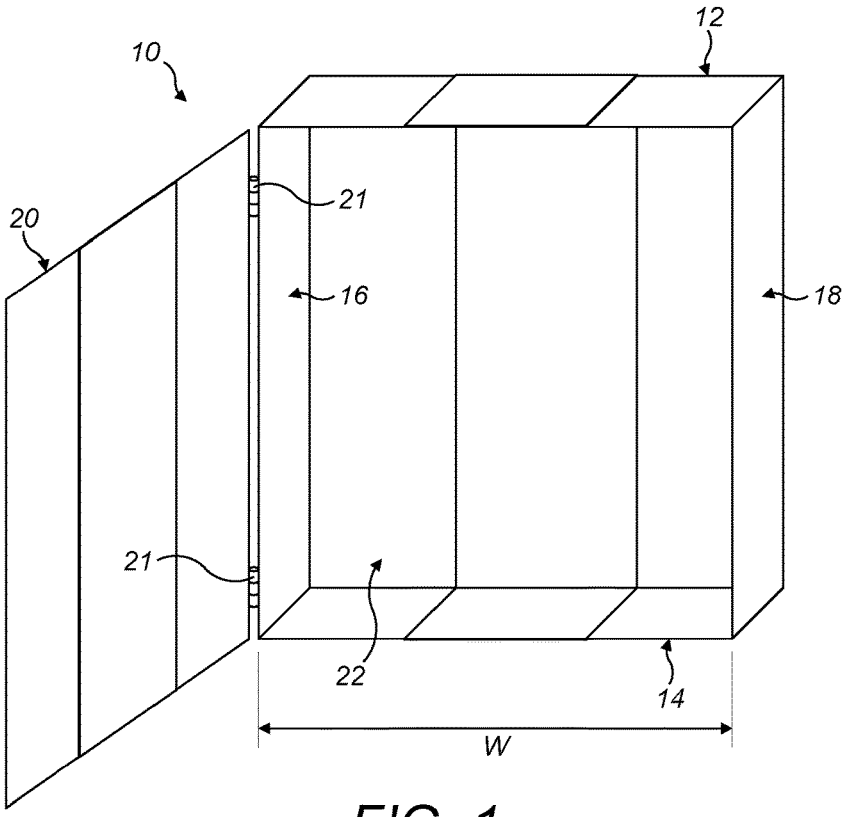
FIG. 1 is a schematic perspective view of an item of furniture such as a wardrobe, cupboard or cabinet in accordance with one embodiment of the present invention.

A first embodiment of the present invention is described with reference to FIGS. 1-3 and relates to an item of furniture such as a wardrobe, cupboard or cabinet. This form of storage structure 10 comprises a body providing a storage volume and made up of top and bottom surfaces 12, 14, left and right sides 16, 18, a front (which serves as a door) 20 and a back 22.

Typically, the storage structure 10 is made of wood, plastic, a composite such as chipboard with a plastic veneer, or any other suitable material. The top and bottom surfaces 12, 14 are secured to the left and right sides 16, 18 by any suitable method such as screws, nails, dowels, adhesive, mortise and tenon joints etc. The back 22 may also be secured to the top, bottom and side walls 12, 14, 16, 18 in this way. The door 20 is typically secured by hinges 21 to either the left side 16, as in FIG. 1, or to the right side 18. A pair of doors, secured to the left and right sides 16, 18 respectively is also possible.

In this embodiment, each side 16, 18 is preferably a single panel of material. However, the top 12, bottom 14, door 20 and back 22 are each formed of at least three slidably engaged panels, as described below, and a linkage, so that a dimension of each wall, and thus a dimension of the whole storage structure 10, in particular the width W, can be adjusted.

Figure 2:
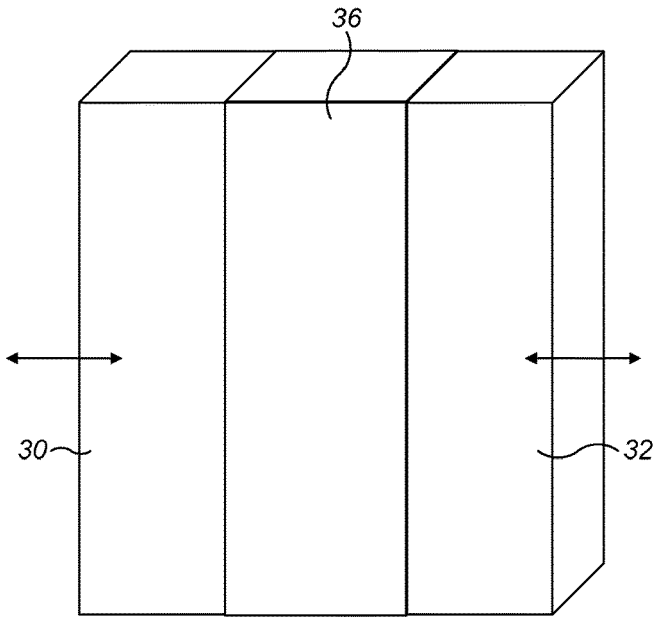
FIG. 2 is a perspective view of one of the expandable walls (or the door) of the item shown in FIG. 1.

FIG. 2 shows a perspective view of the door 20 but this construction is also applicable to the top 12, bottom 14 and back 22 of the storage structure 10, and to any other wall which needs to be extendable. The front 20 comprises a first or left hand panel 30 and a second or right hand panel 32. These panels 30, 32 lie adjacent to one another in the same plane. A third panel 36 forms a central portion of the door 20, and is hollow for receiving the two other panels. At least part of each panel 30, 32 is slidably received within the third panel 36. In particular, a right-hand portion of the left-hand panel 30 is received within the left-hand portion of the third panel 36. Similarly, a left-hand portion of the right-hand panel 32 is slidably received within the right-hand portion of the third panel 36.

Figure 10:
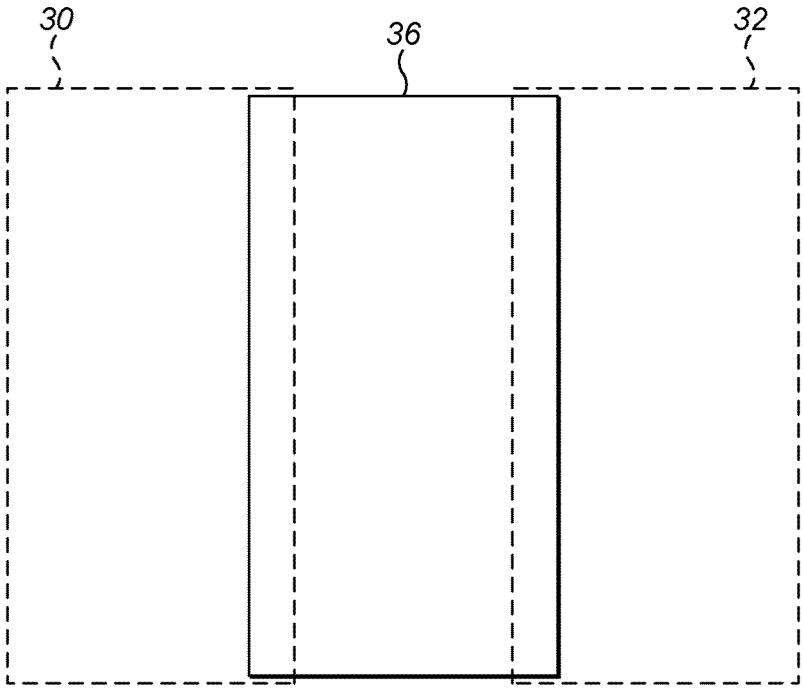
FIG. 10 is a schematic front view of an alternative embodiment of the movable panels of FIG. 2, with the hollow panels shown in dotted lines.

In an alternative embodiment, as shown in FIG. 10, the front 20 may comprise hollow first and second panels 30, 32, which each receive at least a part of the third panel 36. The hollow first and second panels 30, 32 lie adjacent to one another in the same plane.

The first and second panels 30, 32 may slide relative to the third panel 36 as indicated by the arrows. Thus, the first and second panels 30, 32 may be slid towards each other until they meet substantially in the centre of the third panel 36, giving a minimum width dimension W for the door 20. The first and second panels 30, 32 may also be slid away from the other to increase the width W.

Preferably, some form of stop mechanism is provided to limit movement and prevent the panels 30, 32, 36 from disengaging with one another. The stop means thus defines a maximum width dimension W which is possible for the door 20. Between the minimum and maximum, the width W is infinitely adjustable with the first and second panels 30, 32 being positionable at any required point relative to the third panel 36. Preferably, the first and second panels 30, 32 are adjusted equally so that each extends from the third panel 36 to the same extent and the door 20 looks symmetrical. However, the first and second panels 30, 32 could be adjusted to unequal positions if desired.

The first and second panels 30, 32 are joined by a linkage 34 (not visible in FIG. 2 but shown in FIG. 3 and described further below) which allows relative movement of the first and second panels 30, 32 away from and towards each other, within the plane.

In certain embodiments, the third panel 36 extends around the left and right panels 30, 32 and the linkage 34 so that the linkage 34 and at least parts of the first and second panels 30, 32 are covered by the third panel 36 throughout their range of movement away from and towards each other.

In some embodiments the third panel 36 serves to support and guide the first and second panels 30, 32 as they move relative to one another. It ensures that the gap between the first and second panels 30, 32 when they are pulled apart is not visible and the front face of the door 20 still provides a substantially continuous surface.

Figure 3:
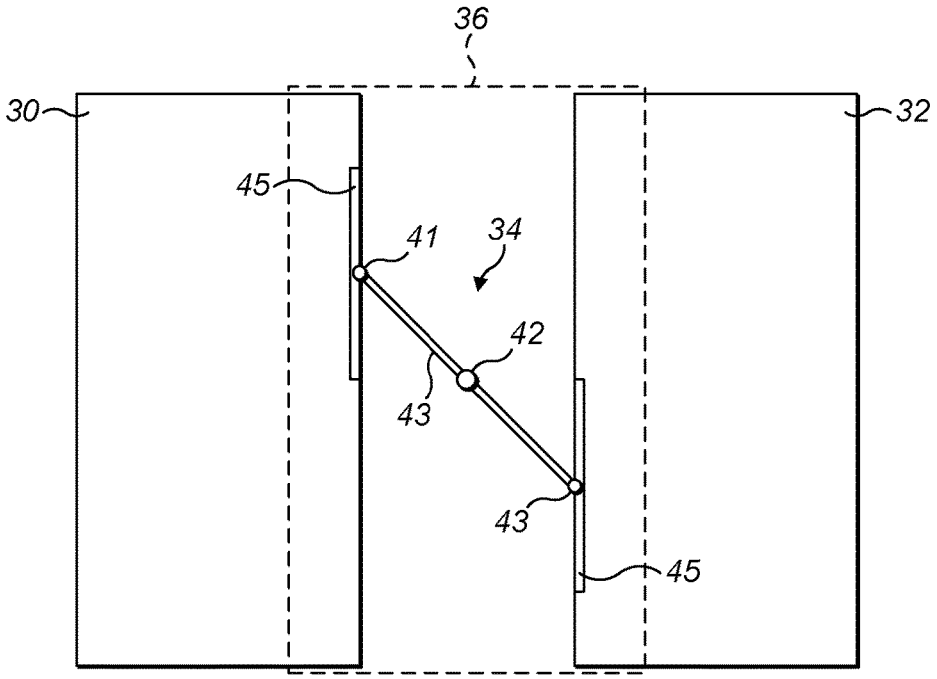
FIG. 3 is a schematic front view of one embodiment of the movable panels and linkage mechanism making up the wall/door of FIG. 2, with the hollow panel shown in dotted lines.

In FIG. 3 the hollow panel 36 extends all the way around the door 20, covering its front and rear surfaces and its top and bottom edges, so that the hollow panel 36 is continuous and defines a generally rectangular passage in which parts of the remaining panels 30, 32 and the linkage 34 are located. This provides maximum strength and rigidity to the door 20 as a whole, and prevents access to the linkage 34 for safety reasons, i.e. to prevent a person catching their fingers in the linkage 34.

However, it would also be possible in the embodiment of FIG. 3 for the hollow panel 36 to extend over the front surface and top and bottom edges and only partially across the rear surfaces of the remaining panels 30, 32 so that the panel 36 is generally C-shaped in cross-section leaving the gap between the first and second panels 30, 32 (and the linkage 34) exposed on the interior side of the door 20.

Similarly in the embodiment of FIG. 10 the hollow panels 30, 32 may be continuous or generally C-shaped in cross-section.

In either embodiment, the first and second panels 30, 32 may simply sit and slide within or over the third panel 36 or there may be some form of additional support and guide means. For example, guide rails may be provided within the third panel 36 to hold and guide the first and second panels 30, 32. Alternatively, or in combination, bearings such as roller bearings or the like could be used within the third panel 36 to support and guide the first and second panels 30, 32. Alternatively, or in combination, the guide rails and/or bearings may be located within the first and second panels 30, 32 in embodiments where these panels are hollow.

The hollow panel(s) 30, 32 or 36 are preferably formed of sheet metal, although plastic, wood, or composite materials are also possible. Any material which can be formed into thin sheets with a comparatively large surface area, while providing sufficient strength, stiffness and rigidity to guide and support the other panels and to ensure that each wall of the storage structure is maintained substantially planar and square, without buckling or bowing, could be used. The hollow panel(s) 30, 32 or 36 may have the same or a different surface finish to the exterior of the remaining panel(s) 30, 32 or 36, as desired. Particularly in the case of the door 20, the hollow panel(s) could be provided with a different surface finish for decorative purposes or could serve as a mounting surface on which a mirror, pinboard or blackboard could be attached. Once the width W of the door 20 is decided upon, the first and second panels 30, 32 may be fixed relative to the third panel 36. The fixing may be permanent, for example, by screws, nails or adhesive, or removable, for example a removable clip securing the first and second panels 30, 32 to the third panel 36. Preferably, the fixing is located on the interior side of the door 20 so as not to affect the exterior appearance.

In the embodiment shown in FIG. 2, the linkage 34 connects the left and right panels 30, 32 together and preferably provides that when one panel is moved, an equal and opposite movement is imparted to the other panel. Thus, if the first and second panels 30, 32 are initially closely adjacent to one another, and the left hand panel 30 is pulled to the left as in FIGS. 2 and 3, the linkage 34 causes the right hand panel 32 to move to the right by an equal distance. This ensures that the door 20 remains symmetrical with the left and right panels 30, 32 extending from each side of the third panel 36 to the same extent.

Various possibilities exist for the exact form of the linkage 34. In one example as shown in FIG. 3, a linkage bar 40 is provided with a first end 41 secured to the first panel 30 and a second end 43 secured to the second panel 32. Each end 41, 43 is preferably secured to a track 45 mounted on the edge of the respective panel 30, 32, or recessed into the edge, such that each end 41, 43 can slide up and down the track 45 and the linkage bar 40 can pivot relative to the panels 30, 32. At the mid-point of the linkage bar 40 it is pivotally secured to the third panel 36 at a pivot point 42. When the first and second panels 30, 32 are close together the linkage bar 40 is at a steep angle or substantially vertical. The first end 41 is at the top of its track 45 and the second end 43 at the bottom of its track 45. As the left hand panel 30 is pulled to the left, the first end 41 slides down and the second end 43 slides up, the linkage bar 40 thus pivots at the pivot point 42 towards a more horizontal position, thereby forcing the right hand panel 32 to slide to the right.

As an alternative, the single linkage bar 40 may be replaced by two separate linkage bars, one joining the left-hand panel 30 to a pivot point on the third panel 36, and the other joining right-hand panel 32 to a pivot point on the third panel 36. In this case, each linkage bar is pivotally secured to a respective panel and a pivot point but there is no sliding track 45 required. The first and second panels 30, 32 can then be moved independently, with each linkage bar pivoting relative to the first and second panels 30, 32 and the third panel 36 as required to accommodate the movement.

Figure 4:
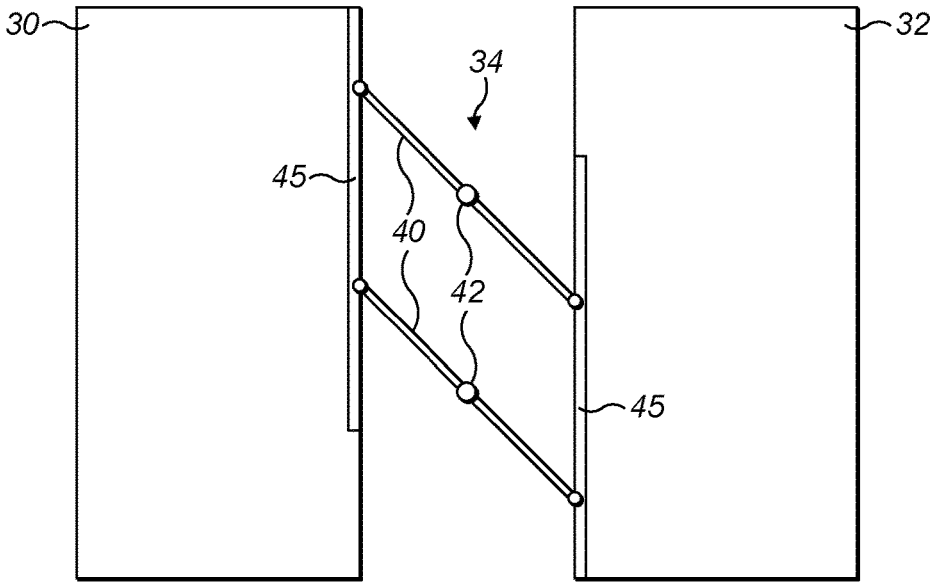
FIGS. 4, 5 and 6 show alternatives to the linkage mechanism of FIG. 3.
Figure 5:
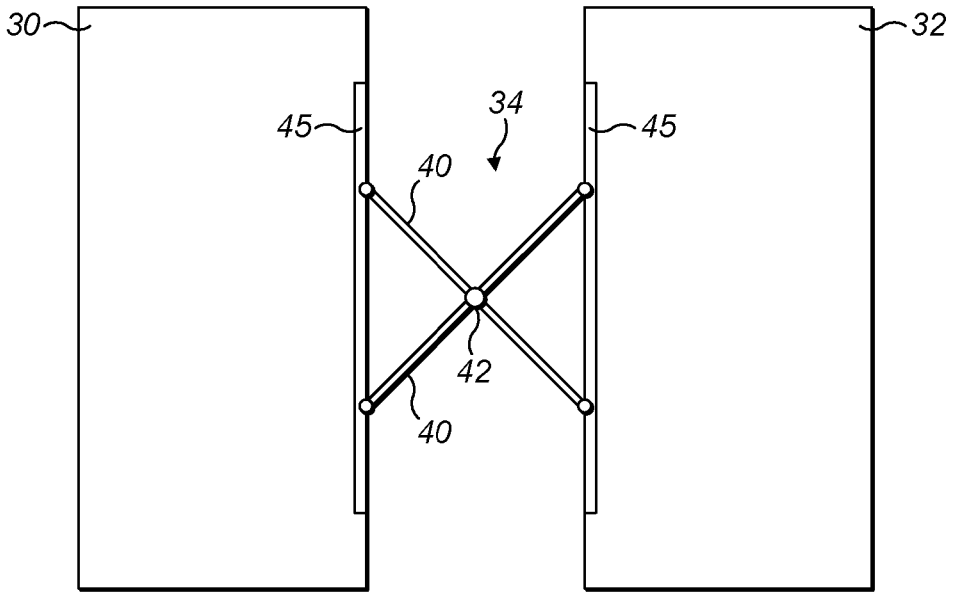
Figure 6:
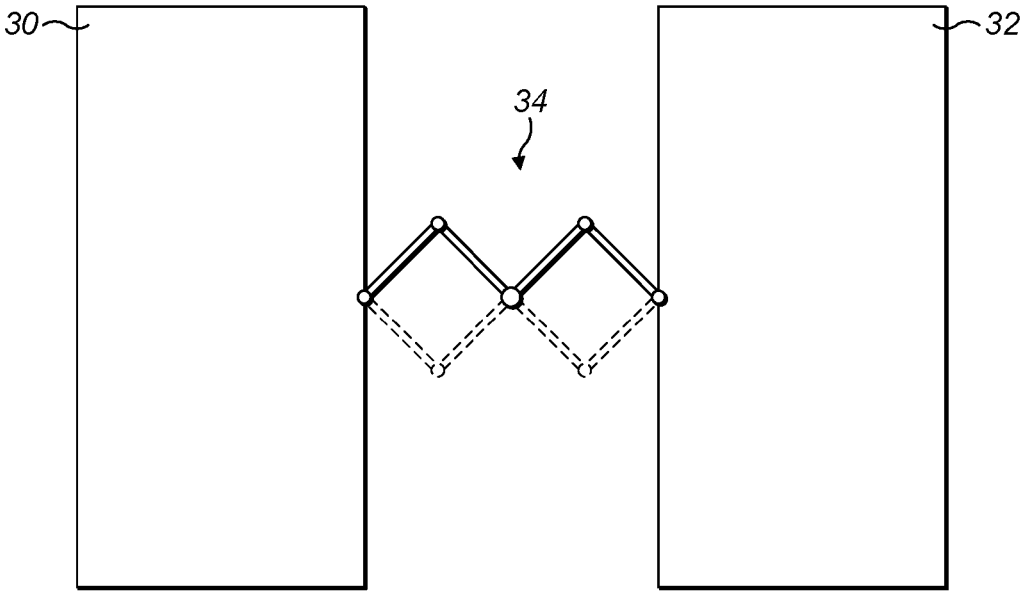

As shown in FIGS. 4-6, more than one linkage bar 40 could be used. Two or more parallel linkage bars 40 at different heights could be used as shown in FIG. 4, or one or more pairs of linkage bars 40 in a cross or scissor configuration could be used as illustrated in FIG. 5. In both cases, the linkage bars 40 are pivotably and slidably secured to tracks 45 on the first and second panels 30, 32 as above.

In another example shown in FIG. 6, a zigzag configuration of linkage may be provided, as shown by the solid lines. This consists of a series of linkage bars each pivotally connected to an adjacent bar. At each end of the zigzag configuration the respective linkage bar is pivotally attached to the first or second panel. A second zigzag linkage as shown by the dotted lines could also be included if desired. Thus, these zigzag configurations allows the linkage to expand and contract, moving the first and second panels 30, 32 towards and away from each other, without the need for the linkage to slide in a track relative to each panel.

Figure 7:
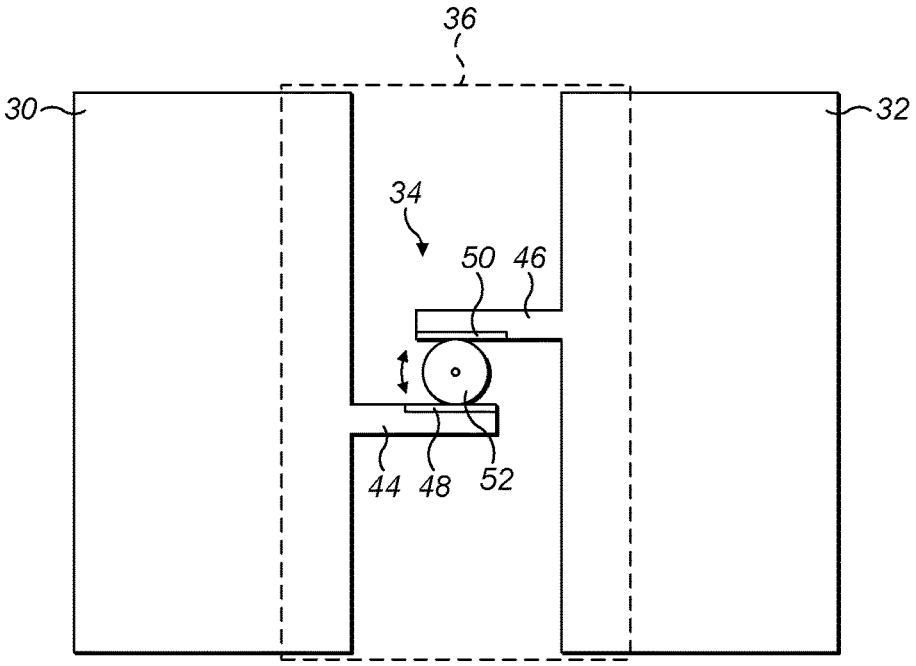
FIG. 7 is a schematic front view of another embodiment of movable panels and linkage mechanism, with the covering guide sleeve shown in dotted lines.

In an alternative embodiment shown in FIG. 7, the first and second panels 30, 32 each have a projecting arm 44, 46 extending towards the opposite panel. The projecting arms 44, 46 are provided at different heights so that they overlap one another. Each arm 44, 46 carries a toothed rack 48, 50. A toothed wheel 52 is rotatably secured to the third panel 36 and engages both toothed racks 48, 50. Thus, if the left hand panel 30 is pulled to the left, the rack 48 will turn the wheel 52, thereby moving the rack 50 and forcing the right hand panel 32 to move to the right.

Although the projecting arms 44, 46 illustrated in FIG. 7 are relatively narrow, it will be appreciated that these projecting portions may be much wider. For the left-hand panel 30, the projecting portion 44 may extend all the way down to the bottom edge of the panel. Likewise, for the right-hand panel 32, the projecting arm 46 may extend all the way up to the top edge of the panel.

Similarly for the embodiment shown in FIG. 10, a linkage 34 connects the left and right panels 30, 32 together and preferably provides that when one panel is moved, an equal and opposite movement is imparted to the other panel. Again the exact form of the linkage 34 may vary, and any embodiment described above may be used. The linkage mechanism for the embodiment of FIG. 10 may be mounted on the back side of the third panel 36, or in certain embodiments the third panel 36 may also be at least partially hollow and the linkage mechanism contained therein as with the previous embodiments. In embodiments where the linkage mechanism is mounted on the back of the third panel 36, the first and second panels 30, 32 are provided with extra clearance such that they are able to receive the protruding linkage mechanism.

It will be appreciated that numerous other types of linkage 34 are possible and any mechanism providing the required movement of the first and second panels 30, 32 could be used.

In this way, the width dimension W of the door 20 can be adjusted by moving the first and second panels 30, 32 relative to one another. The linkage preferably ensures this movement is symmetrical relative to the third panel 36. The exact nature of the linkage mechanism 34 or stop means will determine the minimum and maximum extent of separation between the first and second panels 30, 32 but within that range the door 20 is infinitely adjustable to any desired width. At all times within that range the hollow panel(s) 30, 32 or 36 receive at least a part of the remaining panels 30, 32 or 36 and the linkage 34.

While the examples shown in the Figures depict walls which are expandable in the horizontal direction, it will be appreciated that the above teaching could equally work with a wall which expands in a vertical direction. Such a wall could be used as a side of an item of furniture such as a cupboard, wardrobe or bookcase, or it could be used as a leg or support in a height adjustable piece of furniture. In such a vertically extending wall the linkage mechanism may be provided with sufficient stiffness to resist the urge of gravity to collapse the expansion, or further stop means may be fitted in order to hold the wall in place.

Figure 11:
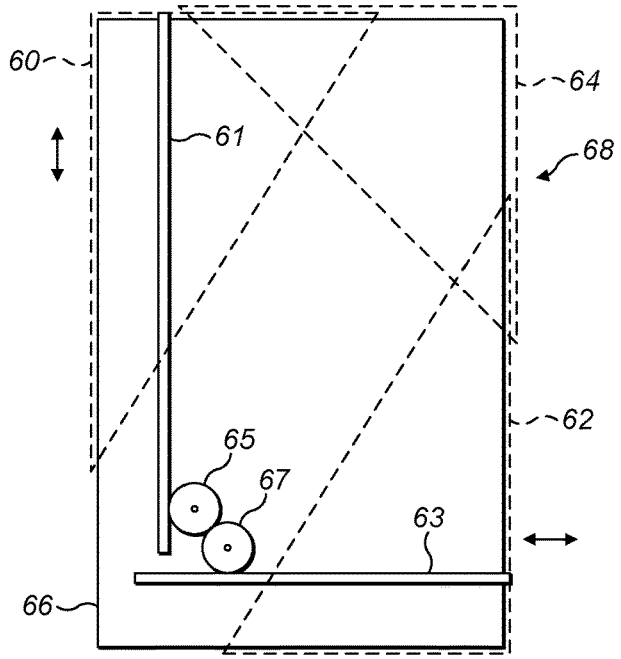
FIGS. 11 and 12 are schematic front views of a further embodiment of the present invention, whereby height and width can both be adjusted.
Figure 12:
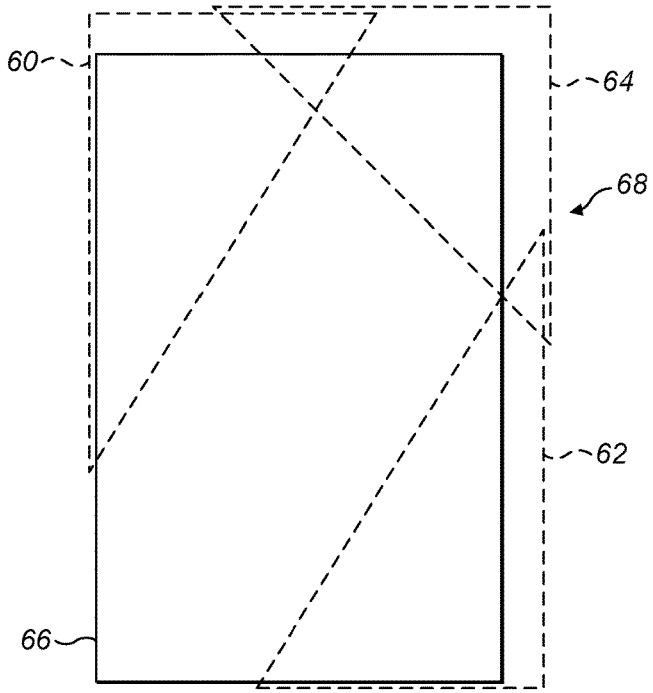

In an alternative embodiment shown in FIGS. 11 and 12 an extendable wall 68 is provided in which it is possible to alter both the width and height dimensions. In this case a centrally located panel 66, is provided with two opposing hollow panels 60, 62 which are co-planar. The central panel 66 is substantially rectangular in shape, and the opposing panels 60, 62 are substantially right-triangular. The first and second panels 60, 62 are hollow for receiving opposing corners of the third panel 66 such that the opposing corners align with the right angles of the triangular panels 60, 62. A fourth panel 64 is provided in a third corner of the third panel 66. The fourth panel is also hollow, and receives a portion of the first, second and third panels 60, 62, 66.

The first and second panels 60, 62 are slidable relative to the third panel 66. The first panel 60 is slidable up and down as shown in FIG. 11, while the second panel 62 is slidable left and right as shown in FIG. 11. Thus the first panel 60 may move to alter the width, and the second panel 62 may move. The fourth panel 64 is engaged with the first and second panels 60, 62 such that it slides with the first and second panels 60, 62 to maintain the substantially rectangular shape of the extendable wall 68 as a whole.

FIG. 11 shows the extendable wall 68 in a first position, wherein the first, second and fourth panels 60, 62, 64 are fully engaged with the third panel 66, and hence the extendable wall is at its minimum height and width.

FIG. 12 shows the extendable wall 68 after the first and second panels 60, 62 have been moved a distance from the position of FIG. 11. The first panel 60 has moved upwards, and the second panel has moved to the right. Panel 64 is slidably engaged such that it has moved upwards and to the right in order to maintain the substantially rectangular shape of the extendable wall 68 as a whole. In this manner the extendable wall 68 can be manipulated to vary its height or width or both, while maintaining the appearance of being a single piece.

A linkage mechanism is included in the extendable wall 68 to connect the first and second panels to allow relative movements between the panels. The linkage mechanism may comprise two toothed racks 61, 63 connected to the first and second panels 60, 62 respectively as shown in FIG. 11. These toothed racks 61, 63 are each engaged with a toothed wheel 65, 67 in an embodiment similar to FIG. 7. The toothed racks are spaced in the dimension perpendicular to the plane of FIG. 11 to allow movement past one another. Thus, if the first panel 60 is moved upwards, the rack 61 will turn the wheel 65, thereby turning the wheel 67 and moving the rack 63 and forcing the second panel 62 to move to the right.

While the toothed wheels 65, 67 are shown engaged with one another, they may be independent such that each panel 60, 62 is able to move independently. Alternatively a single toothed wheel may be provided to fulfil the purpose of the two individual wheels 65, 67.

The fourth panel 64 may also be connected to a linkage mechanism between itself and any of the remaining panels or it may simple passively slide in response to the movements of the first and second panels 60, 62. Any linkage mechanism as described above, or any other suitable mechanism, may be used for this purpose.

Any of the modifications described for the previously recited embodiments of the linkage mechanism may also be applied to the extendable wall 68 of this embodiment. Each of the first and second panels may be provided with their own linkage mechanism for independent movement, or as depicted in FIG. 11 the mechanisms may be linked to make the movement of each panel dependent on the other.

The linkage mechanism for these embodiments may be mounted on the back side of the third panel 66, or in certain embodiments the third panel 66 may also be at least partially hollow and the linkage mechanism contained therein as with the previous embodiments. In embodiments where the linkage mechanism is mounted on the back of the third panel 66, the first, second and third panels 60, 62 and 64 are provided with extra clearance such that they are able to receive the protruding linkage mechanism.

Furthermore, although discussed above with a solid third panel 66 and hollow first and second panels 60, 62 it is also envisioned that the third panel 66 may be hollow and the first and second panels 60, 62 may be solid. In this embodiment the third panel 66 will receive at least a part of the first and second panels 60, 62.

In the case of an item of furniture such as a wardrobe, cupboard or cabinet, the same construction as described above with reference to the door 20 can be used to form the top 12, bottom 14 and back 22. Thus, each of these may be made up of at least two movable panels, and a third panel, with a linkage mechanism. In this case, the back 22 may initially be secured to the left and right sides 16, 18 of the structure 10 so that the width adjustment of the top 12, bottom 14 and back 22 is carried out simultaneously. Alternatively, the back 22 may be provided as a separate item so that when the width of the basic carcass of the structure 10 comprising the top 12, bottom 14 and sides 16, 18 has been adjusted as required, the back 22 can also be adjusted to fit and then fixed in place.

Alternatively, a single continuous third panel 36 of substantially C-shaped cross section may extend around the top 12, back 22 and bottom 14 of the structure 10, in which case the top 12, bottom 14 and back 22 can all be adjusted together.

The door 20 may be hinged to one of the sides 16, 18 from the outset and adjusted in situ, or it may be separate so that it can be adjusted as required and then fitted to the body of the storage structure 10.

It will be apparent that this form of width adjustment mechanism is not limited to wardrobes, cupboards or cabinets and is equally applicable to other types of storage structures as mentioned above.

Figure 8:
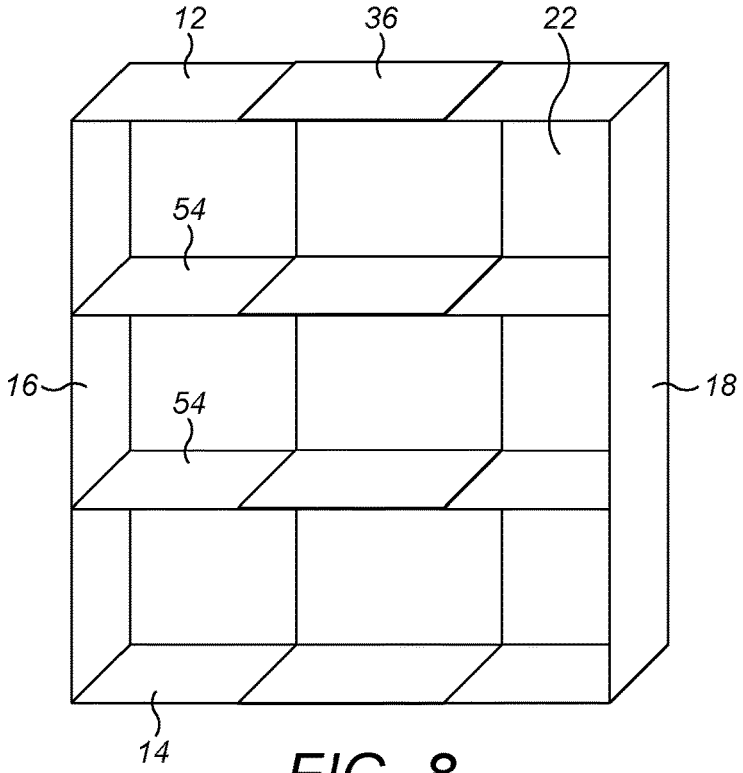
FIG. 8 is a schematic perspective view of another item of furniture such as a shelving unit, bookcase or body of a chest of drawers incorporating the present invention.

For example, an extendable wall of the same type of construction as described above could be used horizontally as a shelf, table top or work surface. A shelving unit or bookcase having a number of horizontal shelves 54 between top and bottom walls 12, 14 (which may themselves constitute shelves) joined by side walls 16, 18 may be extendable by ensuring that each horizontal shelf is formed as an extendable wall as described above. Such a structure may also include a width-adjustable back wall 22. This is illustrated in FIG. 8.

Figure 9:
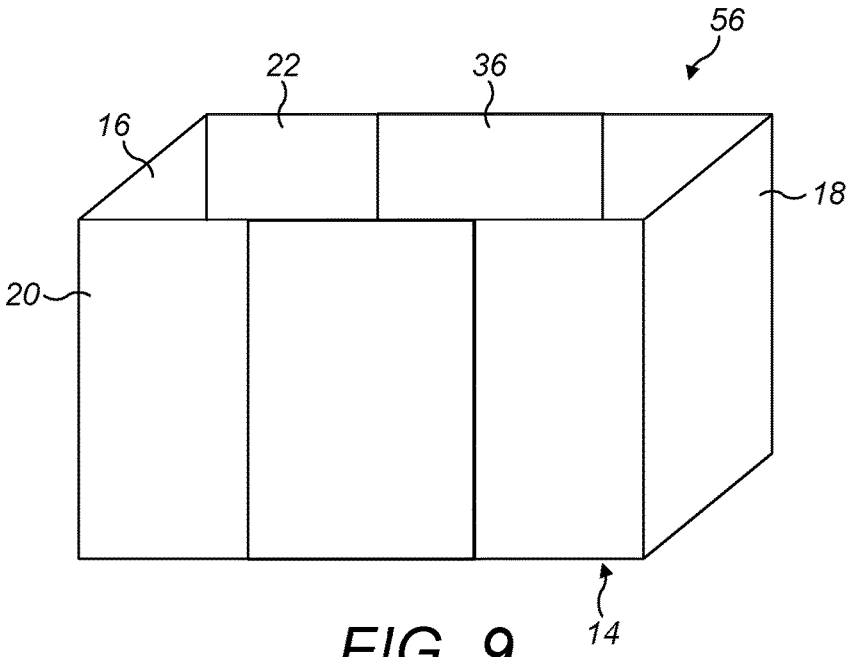
FIG. 9 is a schematic perspective view of an item such as a drawer or box incorporating the present invention.

In the case of a chest of drawers, the top, bottom and back of the chest, and any cross beams supporting the drawers, may be extendable as for the shelving-type structure described above. In addition, each drawer 56 may be extendable with the front, bottom and back each formed of three panels and a connecting linkage as illustrated in FIG. 9. For maximum strength and rigidity there may be a single continuous U-shaped third panel 36 extending around the front, bottom and back of the drawer.

In a similar manner to a drawer, a storage box or chest may be provided with extendable front, bottom and back walls, again possibly with a combined third panel. If required, an extendable lid may be provided which can be hinged to an upper surface of one of the vertical walls.

It will also be appreciated that the invention can be applied to larger size storage structures such as a garden shed or bicycle store.

It will be apparent to the skilled person that the precise construction details, and in particular the nature of any linkage mechanism joining the panels, can be formed in a large number of different ways. Any suitable construction can be used, and preferably one which ensures equal and opposite movement of the first and second panels when one panel is manually adjusted. Within the minimum and maximum range of separation, the adjustment is infinitely variable so that the storage structure can be adapted to fit a variety of locations.

The invention claimed is:

1. A storage structure comprising at least one extendable wall, wherein the extendable wall comprises at least three slidably engaged panels, wherein:

at least a first panel and a second panel are co-planar, wherein the first and second panels are located at opposing sides of a centrally located third panel;

either the third panel is hollow and receives at least part of both the first and second panels, or the first and second panels are hollow and each receive at least part of the third panel;

a fourth panel, which is hollow and slidably engaged to receive at least a part of the first, second and third panels;

the first and second panels are movable relative to each other panel in order to adjust a dimension of the wall; and a linkage mechanism connects the first and the second panels to each other and is configured to allow relative movement between the panels while maintaining the first and second panels in the same plane as each other.

2. A storage structure as claimed in claim 1, wherein the first panel is movable in a first direction relative the third panel, and the second panel is movable in a second direction relative to the third panel, wherein the first and second directions are perpendicular, and the fourth panel is movable in both directions relative to the third panel.

3. A storage structure as claimed in claim 1, wherein the third panel is substantially rectangular, and the first and second panels are substantially right triangular, wherein the first and second panels are mounted such that the right angles of each triangle are arranged to engage with opposing corners of the third panel, and wherein the fourth panel is also substantially right triangular and the right angle of the fourth panel is arranged to engage with a third corner of the third panel.

4. A storage structure comprising:

at least one extendable wall, wherein the extendable wall comprises at least three slidably engaged panels, wherein:

at least a first panel and a second panel are co-planar;

at least one of the panels is hollow and receives at least part of at least one of the other panels;

the first and second panels are movable relative to each other panel in order to adjust a dimension of the wall; and a linkage mechanism connects the first and the second panels to each other and is configured to allow relative movement between the panels while maintaining the first and second panels in the same plane as each other;

wherein the linkage is secured to the third panel, whereby when the first or the second panel moves relative to the third panel, the linkage causes the second or first panel respectively to move by the same distance and in the opposite direction.

5. A storage structure as claimed in claim 4, wherein the linkage comprises at least one linkage bar with a first end pivotally and slidably secured to the first panel, a second end pivotally and slidably secured to the second panel and a midpoint pivotally secured to the third panel.

6. A storage structure as claimed in claim 4, wherein the linkage comprises a plurality of linkage bars, each pivotally secured to an adjacent linkage bar to form a zigzag configuration, and wherein the linkage bar at each end of the zigzag configuration is pivotally secured to a respective panel.

7. A storage structure comprising at least one extendable wall, wherein the extendable wall comprises at least three slidably engaged panels, wherein:

at least a first panel and a second panel are co-planar;

at least one of the panels is hollow and receives at least part of at least one of the other panels;

the first and second panels are movable relative to each other panel in order to adjust a dimension of the wall; and a linkage mechanism connects the first and the second panels to each other and is configured to allow relative movement between the panels while maintaining the first and second panels in the same plane as each other, the linkage comprising a first toothed rack mounted on a projection extending from the first panel, a second toothed rack mounted on a projection extending from the second panel, and a toothed wheel engaged with the first and second toothed racks.

* * * * *